United States Patent [19]

Saika

[11] Patent Number: 4,715,487

[45] Date of Patent: Dec. 29, 1987

[54] CHUTE FOR OPTICAL SELECTOR

[75] Inventor: Nobuo Saika, Wakayama, Japan

[73] Assignee: Toyo Seimaiki Seisakusho K. K., Wakayama, Japan

[21] Appl. No.: 928,589

[22] Filed: Nov. 10, 1986

Related U.S. Application Data

[63] Continuation of Ser. No. 748,203, Jun. 24, 1985, abandoned.

[30] Foreign Application Priority Data

Dec. 28, 1984 [JP] Japan ..... 59-280043

[51] Int. Cl.[4] ..... B07C 5/342

[52] U.S. Cl. ..... 193/2 R; 209/581; 209/911

[58] Field of Search ..... 193/2 R, 9, 25 FT; 209/539, 580, 581, 639, 911, 924; 312/42, 49, 50, 60, 265; 211/59.2, 59.4

[56] References Cited

U.S. PATENT DOCUMENTS

| | | | |
|---|---|---|---|
| 3,381,819 | 5/1968 | Crawford | 209/911 X |
| 4,385,700 | 5/1983 | Hodges et al. | 209/539 |
| 4,454,948 | 6/1984 | Spamer | 211/59.2 |
| 4,496,037 | 1/1985 | Spamer | 193/2 R |
| 4,513,868 | 4/1985 | Culling et al. | 209/581 |

FOREIGN PATENT DOCUMENTS

| | | | |
|---|---|---|---|
| 5916839 | 6/1979 | Japan . | |
| 55-162376 | 6/1979 | Japan . | |
| 5944916 | 8/1979 | Japan . | |
| 5936313 | 9/1979 | Japan . | |
| 5936314 | 10/1979 | Japan . | |
| 789281 | 1/1958 | United Kingdom | 211/59.2 |

*Primary Examiner*—Andres Kashnikow
*Assistant Examiner*—Mary Beth D. Jones
*Attorney, Agent, or Firm*—Browdy and Neimark

[57] ABSTRACT

A chute for an optical selector has a corrugated bottom surface in order to insure that particulate articles to be selected flow linearly and are dispersed uniformly across the width. The corrugations along the bottom surface of the chute are gentle having a small ratio of height to pitch of corrugation, and such corrugations provide shallow valleys which extend linearly from the upper infeed end of the chute to the lower discharge end. When the particulate articles to be selected flow down the chute, they accordingly flow in a linear way rather than following a curved path, but if the flowing quantity becomes so great as to normally cause a vertical piling up at the discharge end, the particulate articles will move sideways rather than piling up.

11 Claims, 4 Drawing Figures

CHUTE FOR OPTICAL SELECTOR

This application is a continuation of application Ser. No. 748,203, filed June 24, 1985, now abandoned without prejudice in favor of the present case.

FIELD OF THE INVENTION

The present invention relates to a chute used for separating and selecting particulate or flat agricultural products such as grains and beans, or particulate mineral and industrial products, by means of detecting surface color tone; and, more especially it relates to such a chute for delivering the particulate materials to be selected to a measuring point in such a way as to optimize optical selection.

BACKGROUND OF THE INVENTION

Optical selectors apply a light to articles to be selected, such as falling particles, measuring light which is reflected and transmitted from the particles, and finally, if there is any abnormality in the surface color tone, detecting those articles or particles which have such a difference in light quality so that the abnormal particle or article is eliminated by means of a blast of air. In that case, there is a necessity of adequately dispersing the particles so as not to pile them up at the location at which the quality of light transmitted therethrough and reflected therefrom is measured. For that purpose, the articles to be selected are accelerated by means of a chute to prevent any build-up. The chute is installed at a vertical inclination, the articles to be measured being supplied at the upper part of the chute, the dead weight of the articles causing them to slide along the surface of the chute. However, if the bottom surface of the chute is simply planar, the articles to be selected may become concentrated only on one side of the chute during their decent.

In order to prevent such a tendency, it has been proposed to provide the chute with corrugations or grooves near the bottom. Even so, if a chute with simple corrugations is used, the downwardly flowing articles tend to become vertically piled up when the flow rate increases, and this presents problems in measurement of the light quantity. For example, if the articles to be selected become piled up, it becomes impossible to measure the quantity of reflected light from certain particles; similarly, if transmitted light is used, the detection of abnormal articles becomes difficult because of a decrease in the light quantity when the articles become piled up. Although such a problem rarely occurs if the articles to be selected have a shape which is approximately spherical, such a problem causes serious concerns particularly when the shape of the articles is flat or long and narrow.

SUMMARY OF THE INVENTION

Accordingly, it is an object of the invention to overcome deficiencies in the prior art, such as indicated above.

It is another object to provide for the improved feeding of articles, such as those having a particulate form, to an optical selector.

It is a further object of the invention to provide a chute for feeding to an optical selector articles to be selected which are small in size and simple in structure.

Yet another object of the present invention is to provide a chute capable of suitably accelerating the articles to be selected to the selection site where selection is executed by an optical selector.

Yet a further object of the invention is to provide a chute capable of having the particles to be selected, which are falling downwardly on the chute, fall in such a way that they are distributed uniformly across the full width of the chute, and also flow downwardly in a linear way.

A still further object of the present invention is to provide a chute wherein when the flowing quantity is increased, the articles to be selected do not become piled up, but instead extend in a sideways direction.

A still further object of the invention is to provide a chute wherein, if the shape of the particulate articles are flat or long and narrow, such particles do not pile up while traveling down the chute.

A still further object of the present invention is to provide a chute capable of increasing the accuracy of selection and enhancing the working efficiency of such selection, when used in conjunction with an optical selector.

BRIEF DESCRIPTION OF DRAWING

Other features and advantages of the invention will be made more apparent by consideration of the following detailed description taken in conjunction with the attached drawings, wherein.

DESCRIPTION OF THE PREFERRED EMBODIMENT

Figure 1:
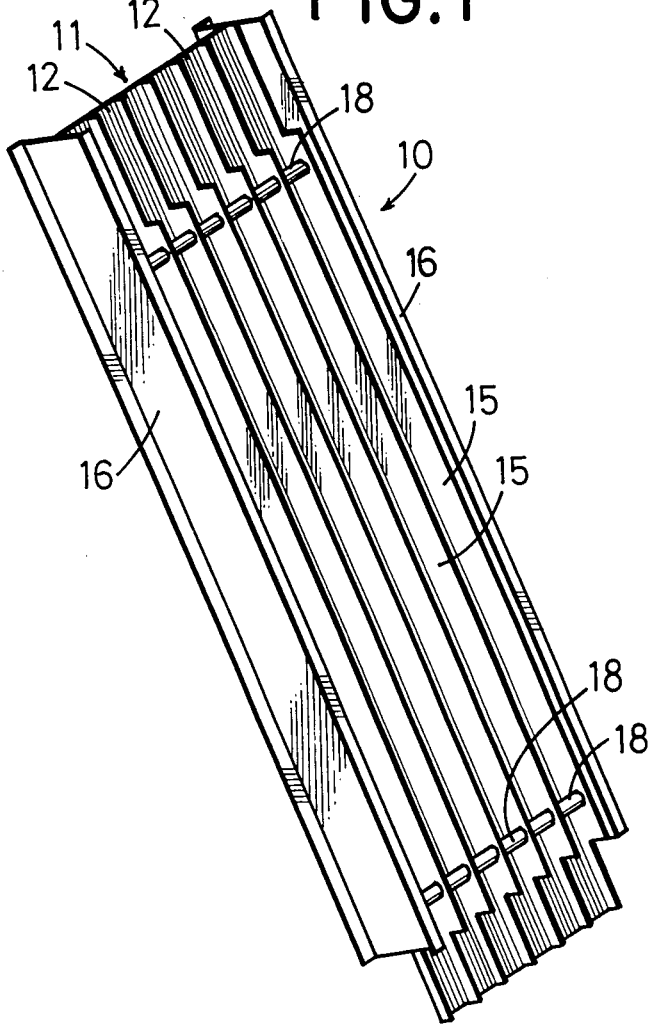
FIG. 1 is a perspective view of a preferred embodiment of the chute according to the present invention.
Figure 2:
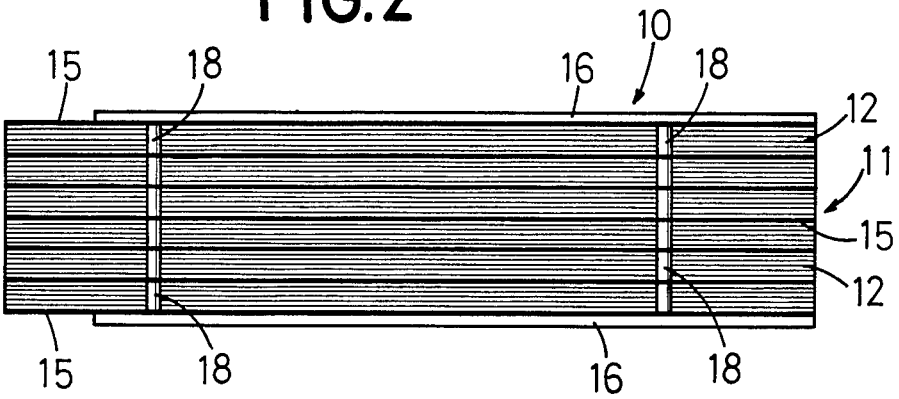
FIG. 2 is a plan view of the chute of FIG. 1.
Figure 3:
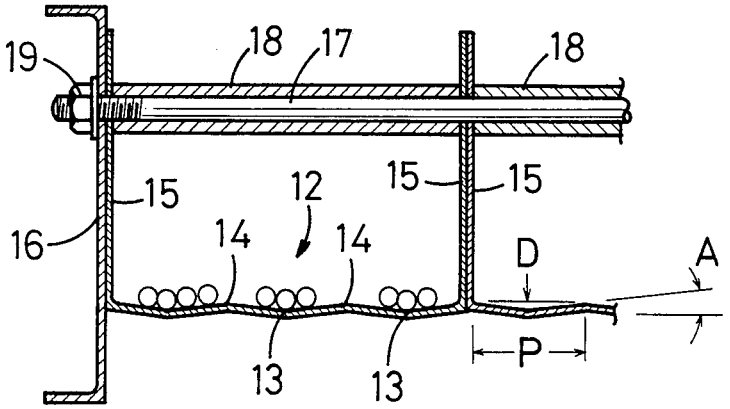
FIG. 3 is a partially enlarged sectional view of the chute of FIG. 1.

The general construction and shape of an embodiment of a chute according to the present invention is shown in FIG. 1. The chute 10 has a bottom surface 11 on which the articles to be selected slide. Such bottom surface 11 comprises a plurality of long and narrow individual plates 12, which are sufficiently long to accelerate the articles to be selected up to the desired speed. As shown in FIG. 3, each plate 12 has a bottom surface which is gently corrugated from one side wall 15 to the other side wall 15, such corrugations having valleys 13 and ridges 14. As FIG. 3 is a cross-section along the width of the device, it will be understood that the gentle corrugations in question run the entire length of each of the plates 12.

Such gentle corrugations have a width P and a depth D as well as an angle of inclination A. These dimensions are variable, depending on the type of articles to be handled by the chute, although in general it will be seen that the width P is substantially greater than the depth D, and that the angle A is small. Additional information is provided below for various specific embodiments.

Referring again to FIG. 1, it will be seen that several plates 12, arranged side-by-side, constitute the sliding bottom face 11 of the chute. The side walls 15 of each plate are interposed between adjacent plates 12 with supporting members 16 being located on the extreme sides of the chute, the supporting members 16 and the sides 15 of the plates 12 being fixed to one another by means of connecting rods 17. The connecting rods 17 not only penetrate the side walls 15 of the plates 12, but are also mounted so that they penetrate and pass through spacers 18 which are inserted into the gap between the side walls 15 of each plate 12, such spacers 18 serving to restrict the dimensions of the gaps. Nuts 19 are screwed to both ends of the rods 17, and when the nuts 19 are tightened, they fix the plates 12 between the supporting members 16. By selecting a rod of proper length and the desired number of plates 12, one can achieve a chute of desired width. In addition, because the chute 10 is formed of the individual plates 12 and held together by rods 17 and nuts 19, with spacers 18, the surface of the chute is not likely to become warped, and this results in a more accurate and predictable traversal of articles to be selected which fall in a linear manner.

Figure 4:
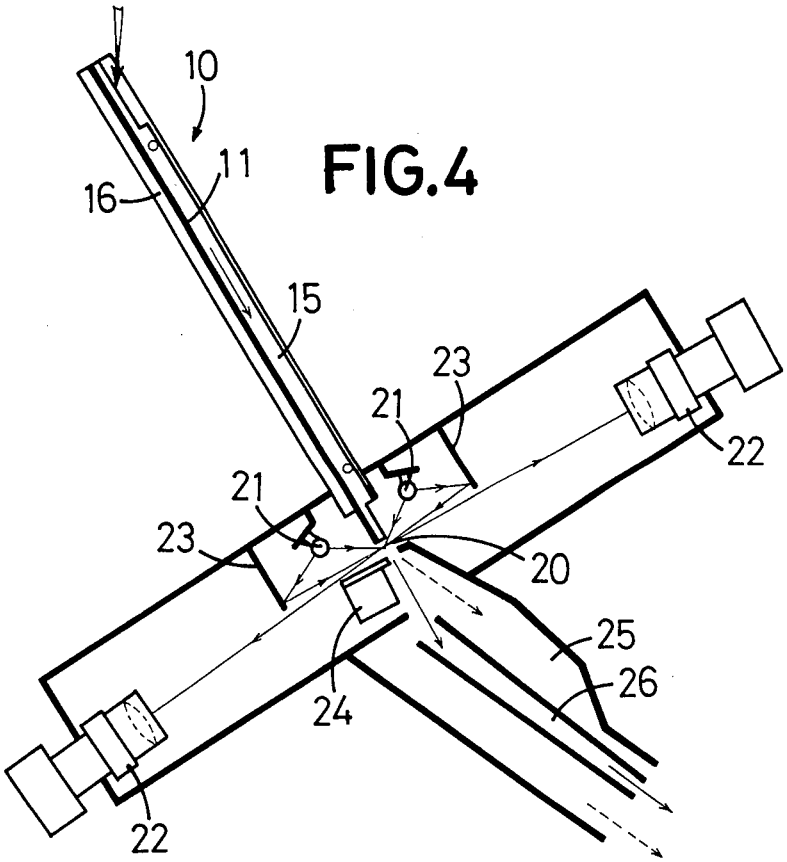
FIG. 4 is a schematic view in outline of the mechanism employing a selector using the chute according to the present invention.

FIG. 4 schematically shows a selector using the above-described chute 10, such chute being mounted at a vertical inclination with particulate articles to be selected being supplied to the upper part thereof, whereupon such articles slide down the chute along the bottom surface 11 thereof. During the sliding, because the surface 11 of the chute 10 is corrugated, the articles to be selected tend to slide or fall along the grooves or valleys 13. Such an arrangement insures that the articles to be selected fall linearly rather than in an erratic path. Furthermore, because the corrugations are gentle, when two particles to be selected flow downwardly along the chute close to one another, they are capable of moving sideways rather than becoming piled up, and this results in avoidance of the particles becoming piled up in one area.

The articles to be selected, which have thus fallen, spring from the lower end of the chute 10 at their predetermined speed. The articles to be selected which have sprung from the chute 10 reach a measuring point 20 located near the lower end of the chute 10. A light from one or more lamps 21 is applied to the double back and front surfaces of the articles to be selected, when they pass the measuring point 20. The reflected light from the articles to be selected, or mixed reflected and transmitted light reaches photo sensors 22 on both the back and front parts. On the other hand, light from the lamp 21 may be applied to backscreens 23 and the reflected light from the backscreens 23 reach the photo sensors 22. The quantity of the reflected light from the backscreen 23 should be in some ratio, such as equal to, the quantity of reflected light or mixed reflected and transmitted light from the particulate articles to be selected which indicate the normal surface color tone.

Yet if the articles to be selected which reach the measuring point 20 are normal, the quantity of light reflected from them turns out to be identical to that of the light from the backscreen 23, in which case the photo sensor 22 is not actuated. In the case of articles having a surface color tone which is abnormal, there will be a difference between the quantity of light reflected from them and that of the light from the backscreen, in which case the photo sensor 22 will detect the abnormality. Upon the detection of such an abnormality by the photo sensor 22, a signal from it is fed to an air injector 24 which instantaneously injects air thereby blowing the falling particulate article into a different path. The air injector 24, located under the measuring point 20, is adjusted so that when an abnormal particle which has been detected at the measuring point 20 falls downward to the position of the air injector, air is blasted from the air injector in order to blow the abnormal article out of its normal trajectory.

The particles which are blown out by the injected air fall into a receiving conduit 25 for abnormal particles, whereas the particles which do not receive the blast air enter into the receiving conduit 26 for normal particles. Thus, the particles which are abnormal in their surface color tone are selected to be eliminated. Because there may sometimes occur the case where the normal particles which are located near the abnormal particles enter into the receiving conduit 25 together with abnormal particles, those particles which have been collected in the abnormal particle receiving conduit 25 are reselected, thereby eliminating only abnormal particles.

The sensors 22 and the air injector 24 constitute an assembly which is illustrated in FIG. 4 in only one plane. Actually, however, the system employs a plurality of sensors 22 and air injectors 24 located beneath the exit point from the chute lying beneath each groove 13. In the illustrated embodiment, as there are eighteen grooves or valleys 13 of the chute 10, it will be understood that what is shown in FIG. 4 is replicated 18 times, each sensor 22 performing the inspection of the quantity of light and the air injector 24 applying the injected air to each of the 18 units.

The preferred examples of the shape of the corrugations of the chute 10 are described as follows. The preferable shape of the corrugation may be varied depending on the kind of articles to be selected, so long as the corrugations are maintained gentle. The following recommended ranges are preferred for the distance P between two adjacent ridges 14 and the depth D from the top of the ridges 14 to the bottom of the valleys 13, it being understood that in general the dimension P may range from 5 mm to 30 mm and the dimension D from 0.1 mm to 5 mm. The preferred range of inclination of the corrugated surface of the chute is from 1° to 20°.

If these dimensions are not adhered to, the following worst case phenomena may take place. For example, in the case of an inclination A of less than 1°, when the articles to be selected fall they may be moved sideways so that they will not fall in a linear way; this usually becomes a significant problem when the flowing quantity is small. On the other hand, in the case of an angle of inclination A of over 20°, when the flowing quantity is relatively great, the phenomenon takes place in which the particulate articles to be selected will become piled-up.

The preferred range for each value for various articles to be selected are summarized as follows.

EXAMPLE I

In the case where the particle articles are grains of rice or wheat, the dimension P should be 5 mm–15 mm, D should be 0.3 mm to 1.0 mm and angle A should be 3° to 8°.

EXAMPLE II

Where the articles are dry noodles 1.2 mm in diameter and 15 mm long, the dimension P should be from 5 mm to 20 mm, dimension D should be from 0.2 mm to 2.5 mm, and angle A should be from 2° to 16°.

EXAMPLE III

In the case of sliced almonds, P should be from 15 mm to 30 mm, D from 0.5 mm to 4.5 mm, and A from 3° to 18°.

EXAMPLE IV

In the case of cotton nuts, P should be from 5 mm to 20 mm, D from 0.5 mm to 3.0 mm and A from 5° to 18°.

The foregoing description of the specific embodiments will so reveal the general nature of the invention that others can, by adapting current knowledge, readily modify and/or adapt such specific embodiments without departing from the generic concept, and therefore such adaptations and modifications should and are intended to be comprehended within the meaning and range of equivalents of the disclosed embodiments. It is to understood that phraseology or terminology employed herein is for the purpose of description and not of limitation.

What is claimed is:

1. A chute for feeding falling articles of a size no greater than that of sliced almonds in a linear manner especially to an optical selector, comprising:

an upper infeed end and a lower discharge end, said lower discharge end being inclined at an angle from the vertical from said upper infeed end, a bottom surface extending from said upper infeed end to said discharge end and providing a generally linear path for the falling articles, said bottom surface being gently corrugated along its width to provide a series of shallow valleys separated by low ridges extending generally the length of said bottom surface from said upper infeed end to said lower discharge end, the inclination of said corrugations being in the range of 1°–20°, the distance between said ridges ranging from 5 mm to 30 mm and the depth of said valleys from the top of said ridges ranging from 0.1 mm to 5 mm.

2. A chute in accordance with claim 1 wherein said bottom surface is formed of a plurality of corrugated plates each possessing a plurality of said shallow valleys.

3. A chute in accordance with claim 2 wherein each of said corrugated plates has generally perpendicular side walls and a plurality of said plates are fixed with said side walls touching one another.

4. A chute in accordance with claim 3 wherein said plates, arranged side-by-side, are fixed as one unit by means of rods penetrating their side walls.

5. A chute in accordance with claim 4 further comprising supporting members along the sides thereof, said rods also penetrating said supporting members, and spacers retained on said rods for maintaining said perpendicular side walls in position.

6. A chute in accordance with claim 1 wherein said bottom surface is formed of at least one plate and is provided with perpendicular side walls.

7. A chute in accordance with claim 6 wherein said bottom surface comprises a plurality of said plates fixed to one another side-by-side and extending the length of said chute.

8. A chute in accordance with claim 1, for feeding grains of rice or wheat, wherein the inclination of said corrugations is in the range of 3° to 8°, the distance between said ridges is from 5 mm to 15 mm, and the depth of said valleys is from 0.3 mm to 1.0 mm.

9. A chute in accordance with claim 1, for feeding dry noodles, wherein the inclination of said corrugations is in the range of 2° to 16°, the distance between said ridges is from 5 mm to 20 mm, and the depth of said valleys is 0.2 mm to 2.5 mm.

10. A chute in accordance with claim 1, for feeding sliced almonds, wherein the inclination of said corrugations is in the range of 3° to 18°, the distance between said ridges is from 15 mm to 30 mm, and the depth of said valleys is from 0.5 mm to 4.5 mm.

11. A chute in accordnace with claim 1, for feeding cotton nuts, wherein the inclination of said corrugations is in the range of 5° to 18°, the distance between said ridges is 5 mm to 20.0 mm and the depth of said valleys is 0.5 mm to 3.0 mm.

* * * * *